US009122228B2

(12) United States Patent
Souda et al.

(10) Patent No.: US 9,122,228 B2
(45) Date of Patent: Sep. 1, 2015

(54) IMAGE FORMING DEVICE HAVING HOLDER POSITIONING ARRANGEMENT

(75) Inventors: Makoto Souda, Nagoya (JP); Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 161 days.

(21) Appl. No.: 13/411,784

(22) Filed: Mar. 5, 2012

(65) Prior Publication Data

US 2013/0004199 A1 Jan. 3, 2013

(30) Foreign Application Priority Data

Jun. 30, 2011 (JP) ..... 2011-146652

(51) Int. Cl.
*G03G 15/00* (2006.01)
*G03G 21/16* (2006.01)
*G03G 21/18* (2006.01)

(52) U.S. Cl.
CPC ..... *G03G 21/1619* (2013.01); *G03G 21/1853* (2013.01); *G03G 2215/0148* (2013.01); *G03G 2221/1654* (2013.01); *G03G 2221/1684* (2013.01)
USPC ..... 399/110

(58) Field of Classification Search
USPC ..... 399/110, 113, 114
See application file for complete search history.

(56) References Cited

U.S. PATENT DOCUMENTS 6,788,321 B2 9/2004 Araki et al.
7,447,467 B2 11/2008 Kamimura et al.
7,580,653 B2 * 8/2009 Idehara et al. ..... 399/110
7,720,413 B2 5/2010 Kamimura et al.
7,778,569 B2 8/2010 Igarashi
7,787,800 B2 * 8/2010 Mori ..... 399/101
7,894,743 B2 2/2011 Tomatsu (Continued)

FOREIGN PATENT DOCUMENTS

CN 1442760 A 9/2003
CN 1797230 A 7/2006

(Continued)

OTHER PUBLICATIONS

Non-Final Office Action received in corresponding U.S. Appl. No. 13/411,749 mailed May 19, 2014.

(Continued)

*Primary Examiner* — Clayton E LaBalle
*Assistant Examiner* — Victor Verbitsky
(74) *Attorney, Agent, or Firm* — Banner & Witcoff, Ltd.

(57) ABSTRACT

An image forming apparatus includes a main frame and a holder. The holder holds a plurality of photosensitive drums arrayed in a predetermined direction. The holder includes a pair of side plates each positioned at each axial end portion of each photosensitive drum, and each having an upstream end portion in the accommodating direction, and a pair of protruding portions each protruding outward in the axial direction from the upstream end portion of each side plate. The main frame includes a pair of positioning portions and a pair of support portions. The pair of positioning portions is configured to be in contact with each protruding portion from below and on a downstream side of the protruding portion in the accommodating direction. The pair of support portions is positioned downstream of the pair of positioning portions in the accommodating direction and configured to support the pair of side plates.

16 Claims, 7 Drawing Sheets

(56) References Cited

U.S. PATENT DOCUMENTS

| | | | | |
|---|---|---|---|---|
| 8,041,255 | B2 | 10/2011 | Igarashi | |
| 8,064,793 | B2 | 11/2011 | Kamimura et al. | |
| 8,200,120 | B2 | 6/2012 | Sato | |
| 8,265,522 | B2 | 9/2012 | Kamimura et al. | |
| 8,311,448 | B2 | 11/2012 | Hashimoto | |
| 8,358,954 | B2 | 1/2013 | Tanaka | |
| 8,457,520 | B2 | 6/2013 | Kamimura et al. | |
| 8,577,255 | B2 | 11/2013 | Okabe | |
| 8,606,142 | B2 | 12/2013 | Kamimura et al. | |
| 2003/0160856 | A1 | 8/2003 | Araki et al. | |
| 2006/0140673 | A1 | 6/2006 | Kamimura et al. | |
| 2007/0147885 | A1 | 6/2007 | Okabe et al. | |
| 2007/0166073 | A1 | 7/2007 | Idehara et al. | |
| 2008/0002341 | A1 | 1/2008 | Tomatsu | |
| 2008/0025749 | A1 | 1/2008 | Igarashi | |
| 2008/0159772 | A1 | 7/2008 | Koishi et al. | |
| 2008/0181691 | A1* | 7/2008 | Watanabe et al. | 399/350 |
| 2009/0028602 | A1 | 1/2009 | Kamimura et al. | |
| 2009/0129812 | A1 | 5/2009 | Kawanami et al. | |
| 2009/0169252 | A1 | 7/2009 | Sato | |
| 2009/0324280 | A1 | 12/2009 | Hashimoto | |
| 2010/0104326 | A1 | 4/2010 | Tanaka | |
| 2010/0111562 | A1* | 5/2010 | Okabe et al. | 399/112 |
| 2010/0135694 | A1* | 6/2010 | Hashimoto et al. | 399/111 |
| 2010/0209140 | A1 | 8/2010 | Kamimura et al. | |
| 2010/0260518 | A1 | 10/2010 | Okabe et al. | |
| 2010/0266311 | A1 | 10/2010 | Igarashi | |
| 2011/0052254 | A1 | 3/2011 | Hashimoto | |
| 2012/0027472 | A1 | 2/2012 | Kamimura et al. | |
| 2012/0251163 | A1 | 10/2012 | Tomatsu et al. | |
| 2012/0251172 | A1 | 10/2012 | Hashimoto et al. | |
| 2012/0308273 | A1 | 12/2012 | Kamimura et al. | |
| 2013/0004198 | A1 | 1/2013 | Tomatsu | |
| 2013/0259524 | A1 | 10/2013 | Kamimura et al. | |
| 2014/0105631 | A1 | 4/2014 | Okabe et al. | |
| 2014/0105644 | A1 | 4/2014 | Kamimura et al. | |
| 2014/0105654 | A1 | 4/2014 | Okabe et al. | |

FOREIGN PATENT DOCUMENTS

| | | | |
|---|---|---|---|
| CN | 1892467 | A | 1/2007 |
| CN | 101149578 | A | 3/2008 |
| CN | 101833262 | A | 9/2010 |
| JP | 2007-178657 | | 7/2007 |
| JP | 2008-009262 | | 1/2008 |
| JP | 2008-049659 | A | 3/2008 |
| JP | 2009-128506 | | 6/2009 |
| JP | 2009-157209 | A | 7/2009 |
| JP | 2010-102175 | A | 5/2010 |
| JP | 2011-070154 | A | 4/2011 |

OTHER PUBLICATIONS

CN Notification of First Office Action mailed Jun. 5, 2014, CN Appln. 201210083978.X, English translation.

CN Notification of First Office Action mailed Jun. 5, 2014, CN Appln. No. 201210083972.2, English translation.

Jan. 20, 2015—(JP) Office Action—App 2011-146652, Eng Tran.

Nov. 3, 2014—(CN) Decision of Rejection—App 201210083978.X—Eng trans.

Feb. 27, 2015—(US) Notice of Allowance—U.S. Appl. No. 13/411,749.

* cited by examiner 400
420
410
421
430
211
212
210
TOP
FRONT
RIGHT
BOTTOM
LEFT
REAR
120
121
111
110
100
42
41
140
150
130
240
250
230
200
10
40

IMAGE FORMING DEVICE HAVING HOLDER POSITIONING ARRANGEMENT

CROSS REFERENCE TO RELATED APPLICATIONS

This application claims priority from Japanese Patent Application No. 2011-146652 filed Jun. 30, 2011. The entire content of the priority application is incorporated herein by reference. Further, the present application is closely related to the co-pending U.S. patent application Ser. No. 13/411,749 filed on Mar. 5, 2012 (corresponding to Japanese Patent Application No. 2011-146657 filed on Jun. 30, 2011).

TECHNICAL FIELD

The present invention relates to an image forming device having a holder that integrally holds a plurality of photosensitive drums.

BACKGROUND

A conventional color printer as an image forming device includes a holder that integrally holds a plurality of photosensitive drums and is movable or can be pulled out relative to a main frame of the color printer. More specifically, the holder includes a pair of metal plates each supporting each axial end portion of each photosensitive drum, and a positioning shaft connecting each front end portion (upstream end portion in accommodating direction of the holder) of each metal plate to each other. Each metal plate has a rear end portion (downstream end portion in the accommodating direction) formed with a notched portion.

Upon completion of accommodation of the holder into the main frame, the notched portion is in abutment with a base shaft extending in lateral direction (axial direction of the photosensitive drum), and the positioning shaft is seated on a metal plate frame provided at the main frame.

SUMMARY

The inventor of the present invention founds that in such a conventional structure, accurate positioning of the holder relative to the main frame cannot be recognized by a user. That is, accurate abutment of the notched portion on the base shaft cannot be recognized because the notched portion is positioned at a deep end or leading end portion of the holder when the holder is accommodated in the main frame.

It is therefore an object of the present invention to provide an image forming apparatus. The image forming apparatus includes a main frame and a holder. The holder is configured to hold a plurality of photosensitive drums arrayed an array direction, and movable in an accommodating direction parallel to the array direction to be accommodated in the main frame. The holder includes a pair of side plates each positioned at each axial end portion of each photosensitive drum, and each having an upstream end portion in the accommodating direction, and a pair of protruding portions each protruding outward in the axial direction from the upstream end portion of each side plate. The main frame includes a pair of positioning portions and a pair of support portions. The pair of positioning portions is each configured to be in contact with a protruding portion from below and on a downstream side of the protruding portion in the accommodating direction for positioning the holder relative to the main frame. The pair of support portions is positioned downstream of the pair of positioning portions in the accommodating direction and configured to support the pair of side plates.

According to another aspect, the present invention provides an image forming apparatus. The image forming apparatus includes a main frame and a holder. The holder holds a photosensitive drum, and is movable in an accommodating direction to be accommodated in the main frame. The holder includes a side plate positioned at an axial end portion of the photosensitive drum, and has an upstream end portion in the accommodating direction and a protruding portion protruding outward in the axial direction from the upstream end portion of the side plate. The main frame includes a positioning portion and a support portion. The positioning portion is configured to be in contact with the protruding portion for positioning the holder relative to the main frame. The support portion is positioned downstream of the positioning portion in the accommodating direction and configured to support the side plate.

BRIEF DESCRIPTION OF THE DRAWINGS

In the drawings;

FIG. 4(*b*) is a perspective view showing a support member in the color printer according to the embodiment;

FIG. 5(*b*) is a partial enlarged side view showing the support member and the holder when the holder is completely accommodated in the main frame in the color printer according to the embodiment;

DETAILED DESCRIPTION

Figure 1:
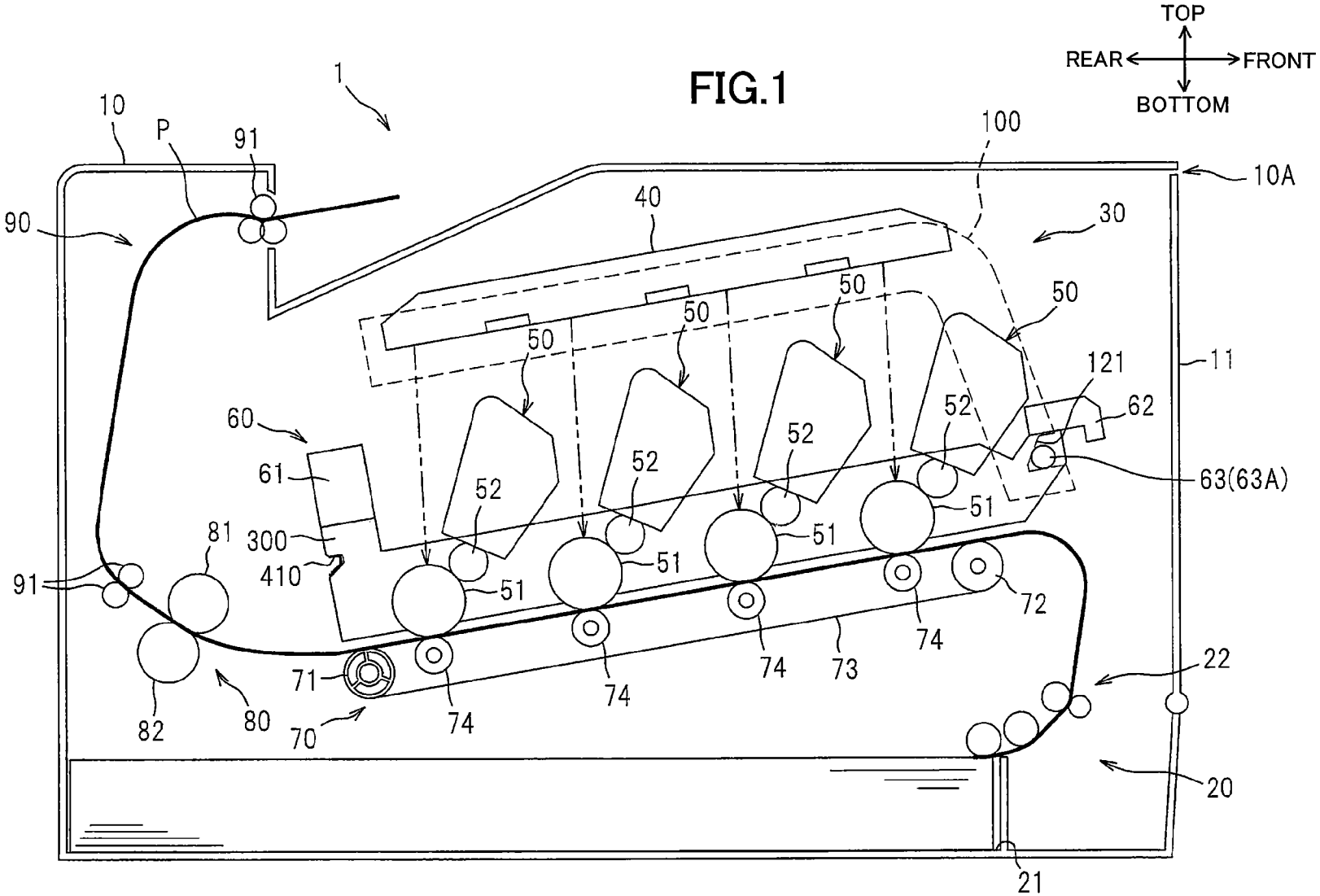
FIG. 1 is a schematic cross-sectional side view of a color printer according to one embodiment of the present invention.

A color printer as an image forming apparatus according to an embodiment of the present invention will be described with reference to FIGS. 1 through 6. Throughout the specification, the terms "upward", "downward", "upper", "lower", "above", "below", "beneath", "right", "left", "front", "rear" and the like will be used assuming that the color printer is disposed in an orientation in which it is intended to be used. More specifically, in FIG. 1 a right side and a left side are a front side and a rear side, respectively.

The color printer 1 includes a main frame 10 in which a sheet feed unit 20 for feeding a sheet P, an image forming unit 30 for forming an image on the sheet P fed by the sheet feed unit 20, and a sheet discharge unit 90 for discharging an image carrying sheet P are provided. The main frame 10 has a front opening 10A at which a front cover 11 is pivotally movably provided.

The sheet feed unit 20 includes a sheet tray 21 for accommodating a stack of sheets P, and a sheet conveying mechanism 22 for conveying a sheet from the sheet tray 21 to the image forming unit 30.

The image forming unit 30 includes a scanner unit 40, four process cartridges 50, a holder 60, a transfer unit 70, and a fixing unit 80. The scanner unit 40 is provided at an upper portion in the main frame 10, and is provided with a laser emitting portion, polygon mirror, a lens, and a reflection mirror those not shown. High speed scanning is performed such that each laser beam can be irradiated on each surface of each photosensitive drum 51 from the scanner unit 40 as indicated by two dotted chain line in FIG. 1. Further, as shown in FIG. 4(*a*), the scanner unit 40 has a casing 41 whose right side wall and a left side wall are respectively provided with three protrusions 42 protruding laterally outward and arrayed in a frontward/rearward direction.

In FIG. 1, the process cartridge 50 are positioned above the sheet feed unit 20 and are arrayed in a predetermined direction, i.e., frontward/rearward direction. Each process cartridge 50 includes the photosensitive drum 51, a charger (not shown), a developing roller 52, and a toner container.

The holder 60 integrally holds four process cartridges 50, and is movable relative to the main frame 10 along a conveyer belt 73 (described later). The holder 60 is accommodated in the main frame 10 by opening the front cover 11 and moving the holder 60 frontward through the opening 10A. In the following description, moving direction of the holder 60 for accommodating the holder 60 into the main frame 10 will be simply referred to as "accommodating direction".

The transfer unit 70 is positioned between the sheet supply unit 20 and the four process cartridges 50, and includes a drive roller 71, a driven roller 72, and the conveyer belt 73, and transfer rollers 74. The drive roller 71 and the driven roller 72 are spaced away from each other in the frontward/rearward direction and extend in a direction parallel to each other. The conveyer belt 73 such as an endless belt is mounted under tension between the drive and driven rollers 71 and 72. More specifically, the drive roller 71 is positioned rearward and downward of the driven roller 72, such that the conveyer belt 73 is oriented diagonally downward and rearward in the accommodating direction.

Four transfer rollers 74 are positioned at an internal space defined by the conveyer belt 73 at positions corresponding to four photosensitive drums 51. Each transfer roller 74 and each photosensitive drum 53 nip the conveyer belt 73. A transfer bias is applied to each transfer roller 74 by a constant current control for image transfer from the photosensitive drum 51 to the sheet P.

The fixing unit 80 is positioned rearward of the process cartridges 50 and the transfer unit 70, and includes a heat roller 81 and a pressure roller 82 in confrontation with the heat roller 81 for pressing the same.

In the image forming unit 30, each surface of each photosensitive drum 51 is uniformly charged by the charger, and then, is exposed to light by the scanner unit 40, so that potential at the exposed area is lowered to form an electrostatic latent image based on image data on the surface of the photosensitive drum 51. Then, toner in the toner container is supplied to the photosensitive drum by the developing roller 52 to form a toner image on the surface of the photosensitive drum 51.

Then, the toner image on the photosensitive drum 51 is transferred onto a sheet P when the sheet P on the conveyer belt 73 passes through and between the photosensitive drum 51 and the transfer roller 74. Then, toner image on the sheet P is thermally fixed when the sheet P passes through and between the heat roller 81 and the pressure roller 82.

The discharge unit 90 includes a plurality of conveyer rollers 91 for conveying the sheet P. The sheet P with the fixed image is conveyed by the conveyer rollers 91 and is discharged outside of the main frame 10.

Next details of the holder 60 and its ambient structure will be described with reference to FIG. 3. The holder 60 includes front and rear frames 61A, 61B made from a resin, a pair of right and left metal plates 300, and a shaft 63. The front frame 61A is spanned between front end portions of the pair of metal plates 300 and is provided with a hand grip 62, so that a user can grip the hand grip 62 to move the holder 60 frontward or rearward. The rear frame 61B is spanned between rear end portions of the pair of metal plates 300.

The metal plates 300 are spaced away from each other in the lateral direction, i.e., axial direction of the photosensitive drum 51 for rotatably supporting the photosensitive drums 51. The metal plates 300 are made from steel, and extend in the frontward/rearward direction, i.e., a direction of an array of the photosensitive drums 51. Each metal plate 300 has front and rear end portions bent upward. Each front upper end portion of each metal plate 300 is formed with a through-hole 310 through which the shaft 63 extends. Each metal plate 300 has a rear upper portion formed with notched portion 320 with which a support member 400 (described later) is engageable.

Figure 5A:
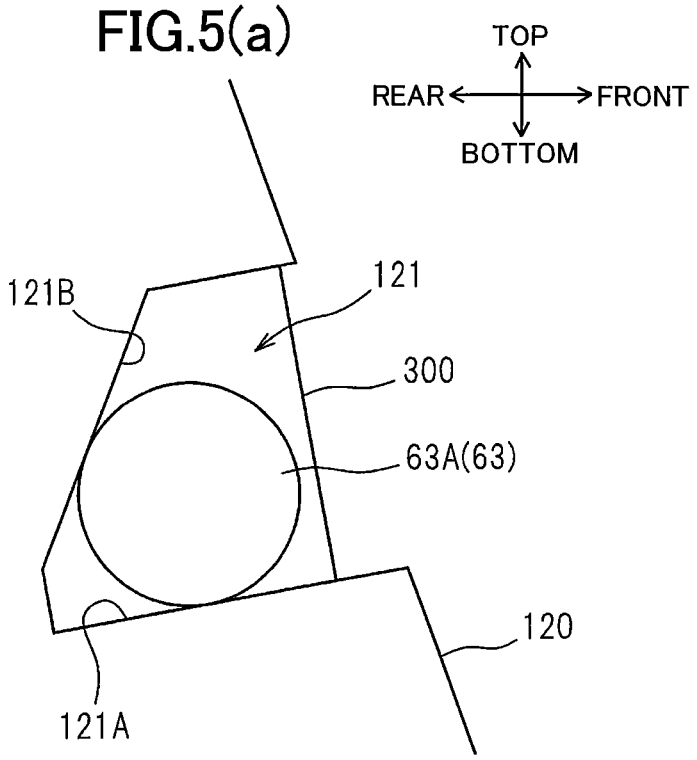
FIG. 5(*a*) is a partial enlarged side view showing a shaft and the holder when the holder is completely accommodated in the main frame in the color printer according to the embodiment.
Figure 5B:
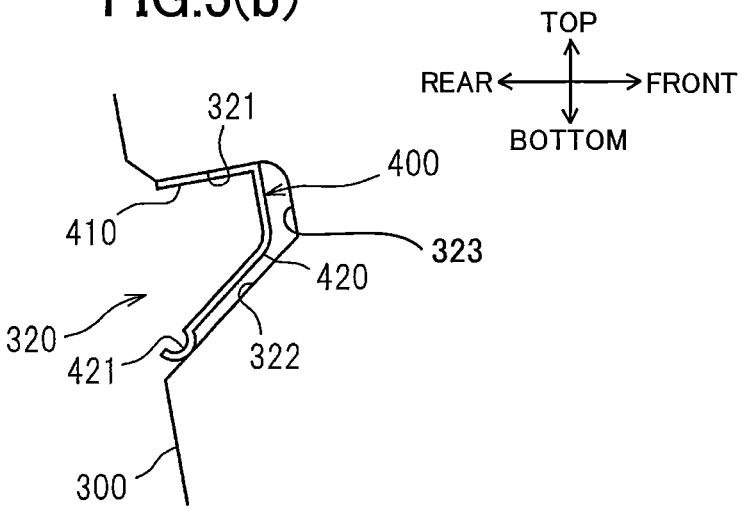

As shown in FIG. 5(*b*), the notched portion 320 is recessed toward frontward from a rearmost end surface of the metal plate 300, and has a supported surface 321 extending in generally frontward/rearward direction, an inclined surface 322 confronting the supported surface 321, and a bottom surface 323 connecting the supported surface 321 to the inclined surface 322. The inclined surface 322 is inclined diagonally downward toward the rear end such that a distance between the supported surface 321 and the inclined surface 322 is gradually reduced toward the bottom surface 323. The notched portion 320 is preferably positioned rearward of the rearmost photosensitive drum 51 (most downstream side drum 51 in the accommodating direction) so that the main frame 10 can stably support the holder 60.

Figure 3:
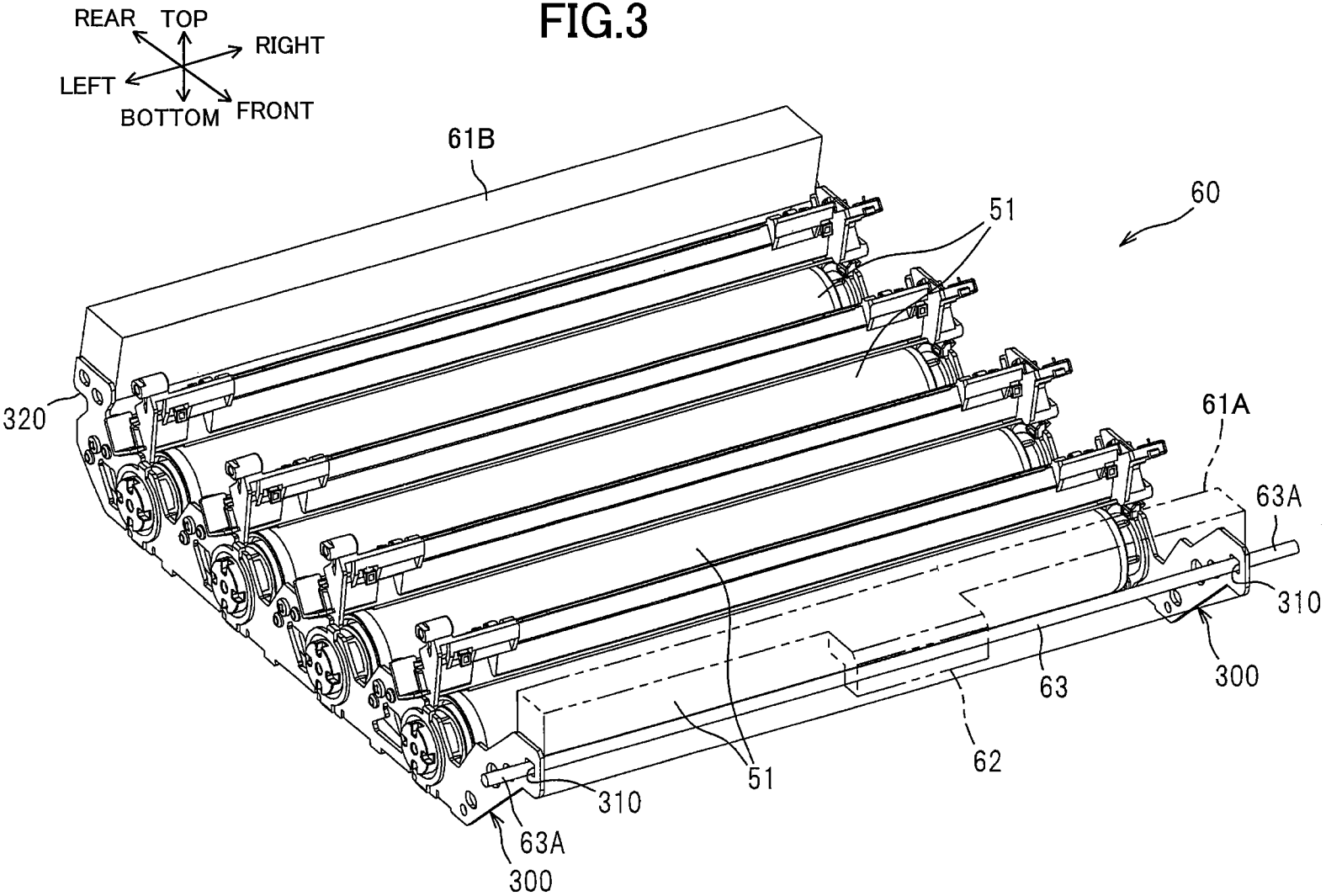
FIG. 3 is a perspective view of the holder and a plurality of photosensitive drums in the color printer according to the embodiment.

As shown in FIG. 3, the shaft 63 extends in the lateral direction, i.e., axial direction of the photosensitive drum 51 and is made from a metal. Each end of the shaft 63 is fitted with each through-hole 310, thereby linking the pair of metal plates 300 together. Each axial end portion 63A of the shaft 63 protrudes laterally outward from each metal plate 300 to provide a pair of protruding portions to be supported to a metal plate frame 100 (described later) of the main frame 10. Each protruding portion 63A is preferably positioned upstream of the most upstream side photosensitive drum 51 so that the holder 60 can be stably supported to the main frame 10.

As shown in FIG. 4(*a*) the main frame 10 includes a pair of metal plate frames 100, a pair of resin plate frames 200, and the support member 400. In FIG. 4(*a*), a right side resin plate frame 200 is not shown for simplicity.

Each metal plate frame 100 is positioned laterally outward of each metal plate 300 when the holder 60 is accommodated in the main frame 10, and is positioned offset from the four photosensitive drums 51 as viewed in the axial direction of the photosensitive drum 51 (in side view). More specifically, each metal plate frame 100 is generally L-shaped in side view and includes a major portion 110 and an extension portion 120. The major portion 110 is positioned above the photosensitive drums 51 and superposed with the scanner unit 40 in side view, and extends in generally frontward/rearward direction. The extension portion 120 extends downward (toward the photosensitive drums 51) from a front end portion of the major portion 110.

The major portion 110 is formed with three holes 111 arrayed in the frontward/rearward direction for engagement with the three protrusions 42 protruding from the casing 41 of the scanner unit 40, thereby supporting the scanner unit 40 to the major portion 110.

Figures 4A, 4B:
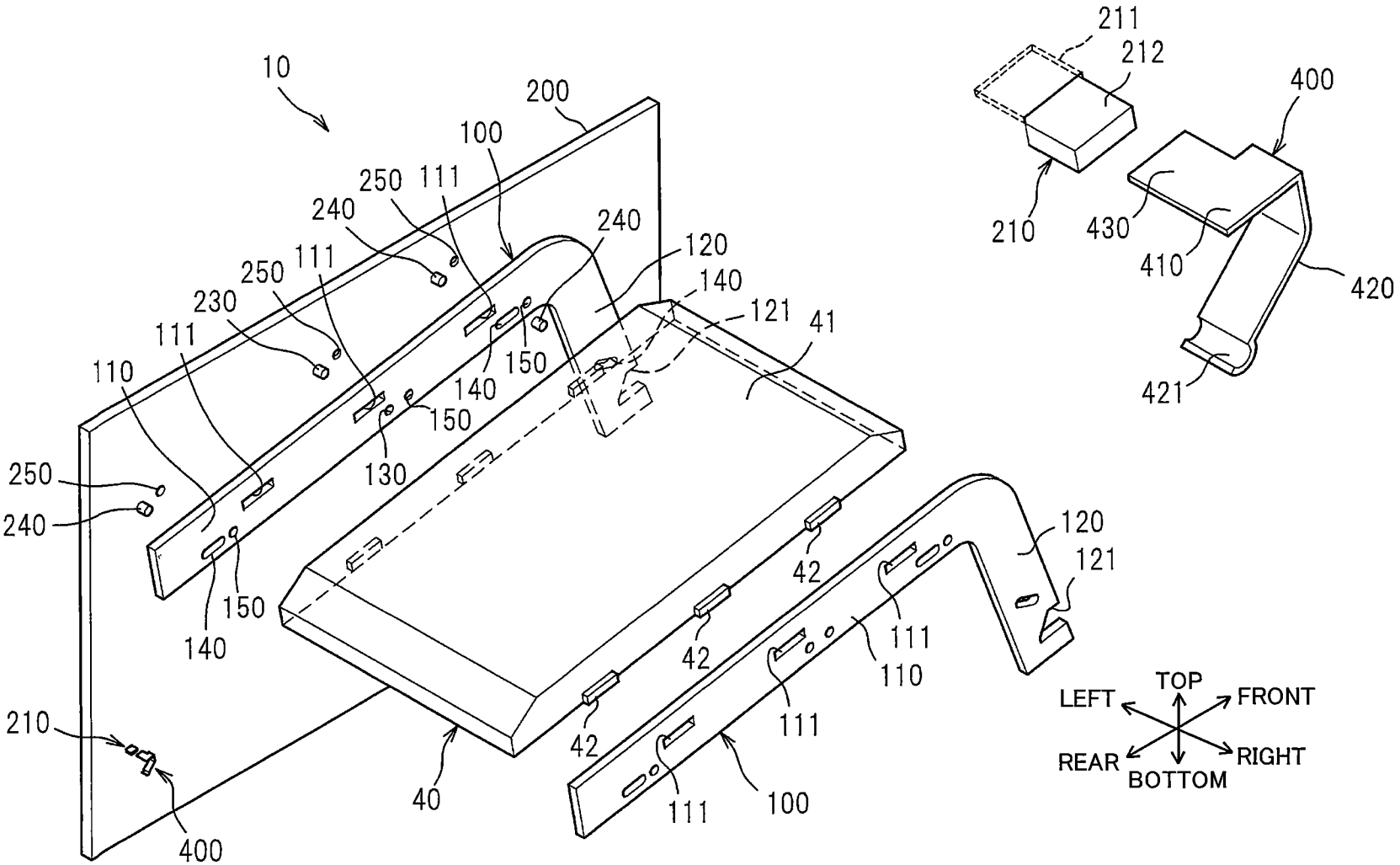
FIG. 4(*a*) is a perspective view showing a scanner unit, a metal plate frame, and a resin plate frame, in the color printer according to the embodiment.
Figure 6:
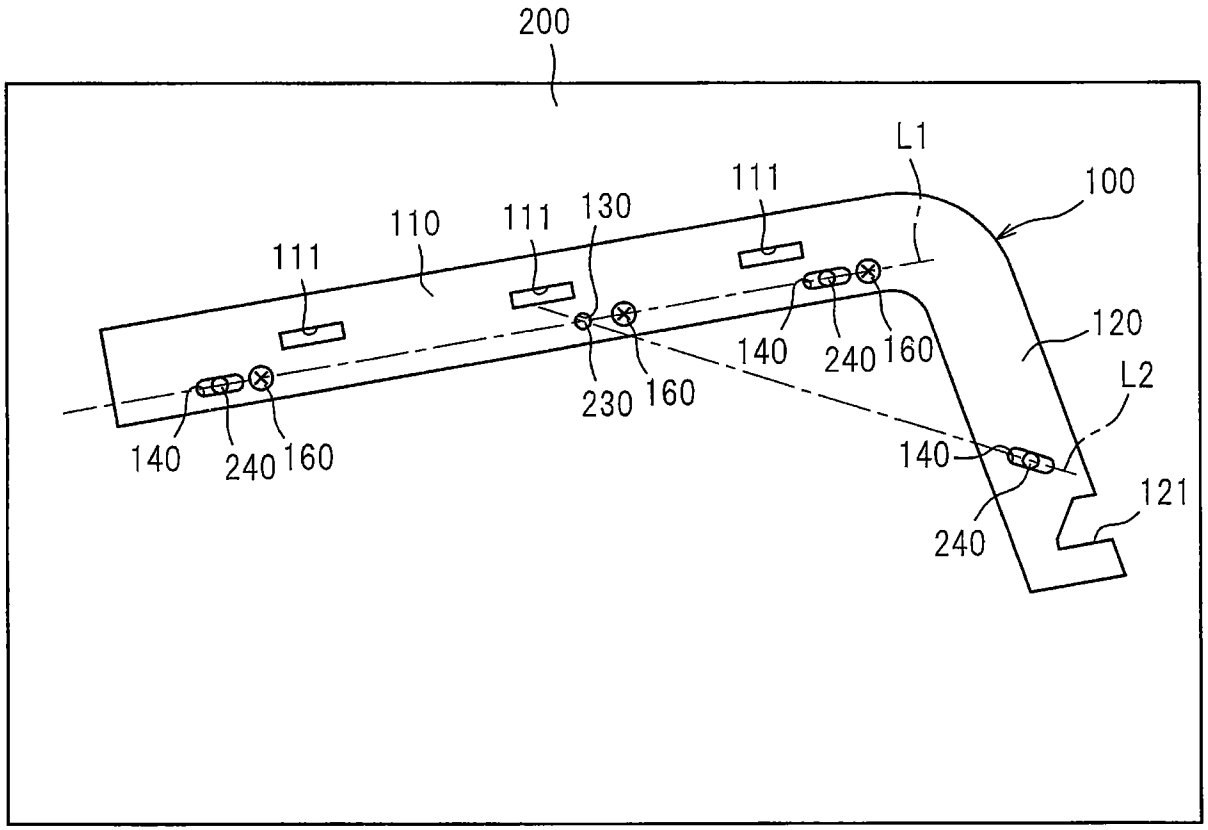
FIG. 6 is a side view of the resin plate frame and the metal plate frame in the color printer according to the embodiment.

The extension portion 120 is formed with a notched portion 121. As shown in FIG. 5(*a*), the notched portion 121 is recessed rearward from a front end surface of the extension portion 120, and is tapered rearward. More specifically, the notched portion 121 is defined by a first surface 121A extending in generally frontward/rearward direction, and a second surface 121B positioned above the first surface 121A and oriented diagonally downward and rearward. The notched portion 121 is positioned capable of being visible when the front cover 11 is opened As shown in FIG. 6, the metal plate frame 100 is formed with a single positioning hole 130, three elongated slots 140, and three insertion holes 150 (FIG. 4*a*). The positioning hole 130 extends through a thickness of the metal plate frame 100 and is positioned at a generally longitudinal center portion of the major portion 110. The three elongated slots 140 also extend through the thickness of the metal plate frame 100. Among these, two elongated slots 140 are provided in the major portion 110 and positioned such that the positioning hole 130 is positioned between the two elongated slots 140. Remaining one elongated slot 140 is provided in the extension portion 120 at a position close to the notched portion 121.

The two elongated slots 140 formed in the major portion 110 and the positioning hole 130 are aligned on an imaginary line L1 extending in a direction parallel to a direction of array of the photosensitive drums 51. Further, elongating direction of the slots 140 is also aligned with the line L1. Further, an elongating direction of the remaining slot 140 formed in the extension portion 120 is coincident with a line L2 described later. Further, as shown in FIGS. 4(*a*) and 6, the three insertion holes 150 are adapted to allow screws 160 to pass therethrough. Among these, one insertion hole 150 is positioned adjacent to the positioning hole 130, and remaining insertion holes 150 are positioned adjacent to the elongated slots 140, respectively.

The resin plate frames 200 are in confrontation with each other and are positioned laterally outward of the pair of metal plate frames 100. As shown in FIG. 4(*a*), each resin plate frame 200 has an inner lower rear portion provided with an attachment portion 210 for attaching the support member 400 to the resin plate frame 200.

As shown in FIG. 4(*b*), the attachment portion 210 has an attachment hole 211 formed in the resin plate frame 200 and a flat reinforcement portion 212 protruding laterally inward from the lower edge portion of the attachment hole 211.

The support member 400 is formed by bending a single metal plate into generally U-shape. More specifically, each support member 400 includes a support part 410 extending in generally frontward/rearward direction, a leaf spring part 420, and an insertion part 430. The leaf spring part 420 extends downward from a front end of the support part 410 and then extends diagonally downward and rearward. The insertion part 430 extends toward the resin frame part 100 from the support part 410 and into the attachment hole 211. The leaf spring part 420 has a lower portion provided with an arcuate bent portion 421 protruding downward in side view.

The support member 400 is attached to the resin plate frame 200 by insertion of the insertion part 430 into the attachment hole 211. Further, the support part 410 is mounted on and in intimate contact with the reinforcement portion 212.

As shown in FIGS. 4(*a*) and 6, the resin plate frame 200 has a positioning boss 230, three projections 240, and three female threads 250. The positioning boss 230 and the three projections 240 protrude laterally inward from a laterally inner surface of each resin plate frame 200. The positioning boss 230 is positioned to fit with the positioning hole 130, and has an outer diameter approximately the same as an inner diameter of the positioning hole 130. The three projections 240 are positioned to fit with the three elongated slots 140. The three female threads 250 are positioned to align with the three insertion hole 150. Thus, the screws 160 passing through the insertion holes 150 are threadingly engaged with the female thread 250.

Here, the above-described line L1 passes through a central axis of the positioning boss 230 and each center of each elongated slot 140. Further, the above-described line L2 passes through a central axis of the projection 240 fitted with the elongated slot 140 formed in the extension portion 120 and the central axis of the positioning boss 230.

The metal plate frame 100 can be positioned to the resin plate frame 200 by fitting the positioning boss 230 with the positioning hole 130 and by engaging the projections 240 with the elongate slots 140. More specifically, by the fitting engagement of the positioning boss 230 with the positioning hole 130, the metal plate frame 100 is temporarily positioned to the resin plate frame 200. Then, by the engagement of the projections 240 with the elongated slots 140, pivotal movement of the metal plate frame 100 about the axis of the positioning boss 230 can be prevented. In this way, the metal plate frame 100 can be positioned to the resin plate frame 200 such that positional relationship between the four photosensitive drums 51 supported to the metal plates 300 and the scanner unit 40 supported to the major portions 110 can be stably maintained.

Incidentally, because each slot 140 is elongated in a direction along the line L1 and L2, a constant distance between the scanner unit 40 and the photosensitive drums 51 can be maintained by relative sliding movement between each projection 240 and each elongated slot 140 even if dimension of the resin plate frame 200 is varied due to its thermal expansion. Then, the metal plate frame 100 is fixed to the resin plate frame 200 by fastening the screws 160 passing through the insertion hole 150 and engaged with the female thread 250.

Figure 2:
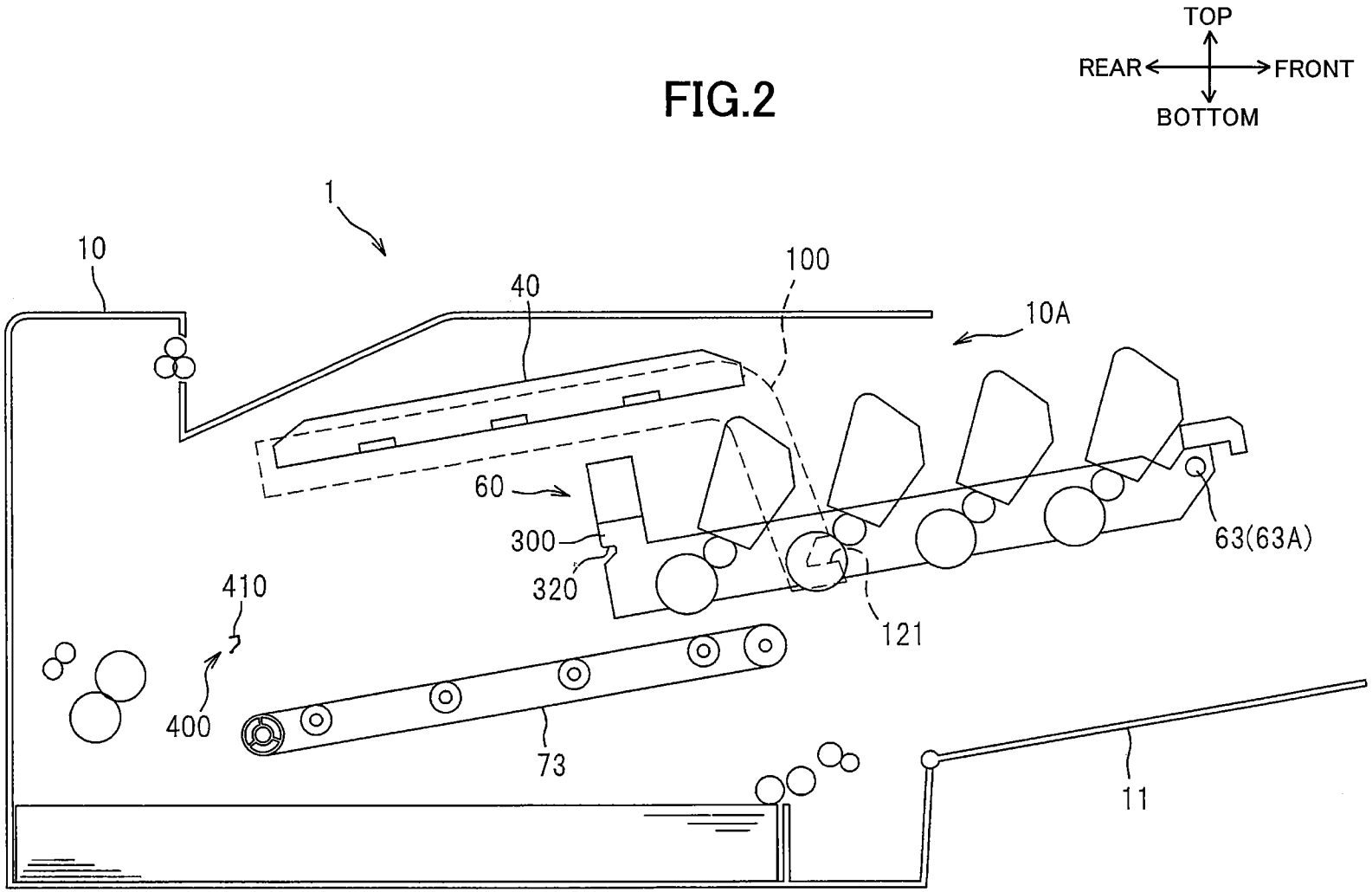
FIG. 2 is a view showing a state where a holder is pulled out from a main frame of the color printer according to the embodiment.

Next positioning of the holder 60 to the main frame 10 will be described. As shown in FIG. 2, for accommodating the holder 60 in the main frame 10, a user opens the front cover 11, and inserts the holder 60 rearward and diagonally downward along the conveyer belt 73. Since the conveyer belt 73 is inclined downward toward the accommodating direction, the holder 60 can be moved downward because of its own weight.

In the accommodating state of the holder 60, each axial end portion 63A of the shaft 63 of the holder 60 is engaged with each notched portion 121 of the main frame 10 side. In this case, each axial end portion 63A is in intimate contact with the notched portion 121 because of the weight of the holder 60. More specifically, as shown in FIG. 5(*a*), the first surface 121A of the notched portion 121 is in abutment with the axial end portion 63A from below. Therefore, downward displacement of the holder 60 due to its own weight can be prevented. Thus, vertical position of the holder 60 can be fixed. Further, the second surface 121B of the notched portion 121 is in abutment with the axial end portion 63A from diagonally above and on a downstream side of the axial end portion 63A. Therefore, displacement of the holder 60 in the downstream direction (in the accommodating direction) due to the weight of the holder 60 can be prevented. Accordingly, frontward/rearward position of the holder 60 can be fixed. Further, since the axial end portion 63A is nipped between the first and second surfaces 121A and 121B, vertical rattling of the holder 60 can be prevented.

While the axial end portion 63A of the shaft 63 is engaged with the notched portion 121, each notched portion 320 of the holder 60 is engaged with the support member 400 as shown in FIG. 5(*b*). More specifically, the supported surface 321 of notched portion 320 is in contact with the support part 410 of the support member 400, so that the support part 410 supports the holder 60 from below. Accordingly pivotal movement of the holder 60 about an axis of the shaft 63 is prevented, thereby stably positioning the holder 60. Further, the bent portion 421 of the leaf spring part 420 is in contact with the inclined surface 322, so that the leaf spring part 420 urges the inclined surface 322 downward. Consequently, the support surface 321 and the inclined surface 322 can receive urging force from the support member 400. Thus, vertical rattling of the holder 60 can further be prevented.

In this way, positioning of the holder 60 relative to the main frame 10 can be attained. The above-described positioning arrangement can lead to cost reduction in comparison with a conventional structure where a holder has a positioning shaft and a main frame has a metallic base shaft. That is, although two shafts are provided in the conventional structure in order to position the holder relative to the main frame, in the embodiment, the positioning of the holder 60 is provided by the shaft 230 and the support member 400 which has a lower cost than the shaft of the conventional structure.

Further, since the notched portion 121 of the main frame side and the axial end portion 63A of the shaft 63 of the holder side are not positioned at deep side but positioned at near side in the accommodating direction, positioning of the holder 60 relative to the main frame 10 can be visually recognized.

Further, since the holder 60 is accommodated in the main frame in the inclined posture, the axial end portion 63A of the shaft 63 can be in intimate contact with the notched portion 121 because of the weight of the holder 60. Thus, stabilized positioning of the holder 60 can be provided.

Further, the frame 100 formed with the notched portion 121 is made from a metal, positioning accuracy of the holder can be enhanced in comparison with a case where the frame is made from a resin.

Further, since each axial end portion 63A (protruding portion protruding from the metal plate 300) is a part of the single shaft 63 made from a metal, accurate positioning of the holder 60 can be attained in comparison with a case where protruding portions are separate from each other.

Further, the metal plate frame 100 includes the major portion 110 and the extension portion 120. That is, the portion for accurate positioning of the holder 60 is constituted only by the metal plate frame 100. Accordingly, the color printer can be produced at low cost because of the compact structure of the metal plate frame 100.

Further, since the support part 410 supporting the rear end portion of the holder 60 is not provided at the metal plate frame 100 but is provided at the frame 200 made from resin, the metal plate frame 100 can further be downsized.

Figure 7:
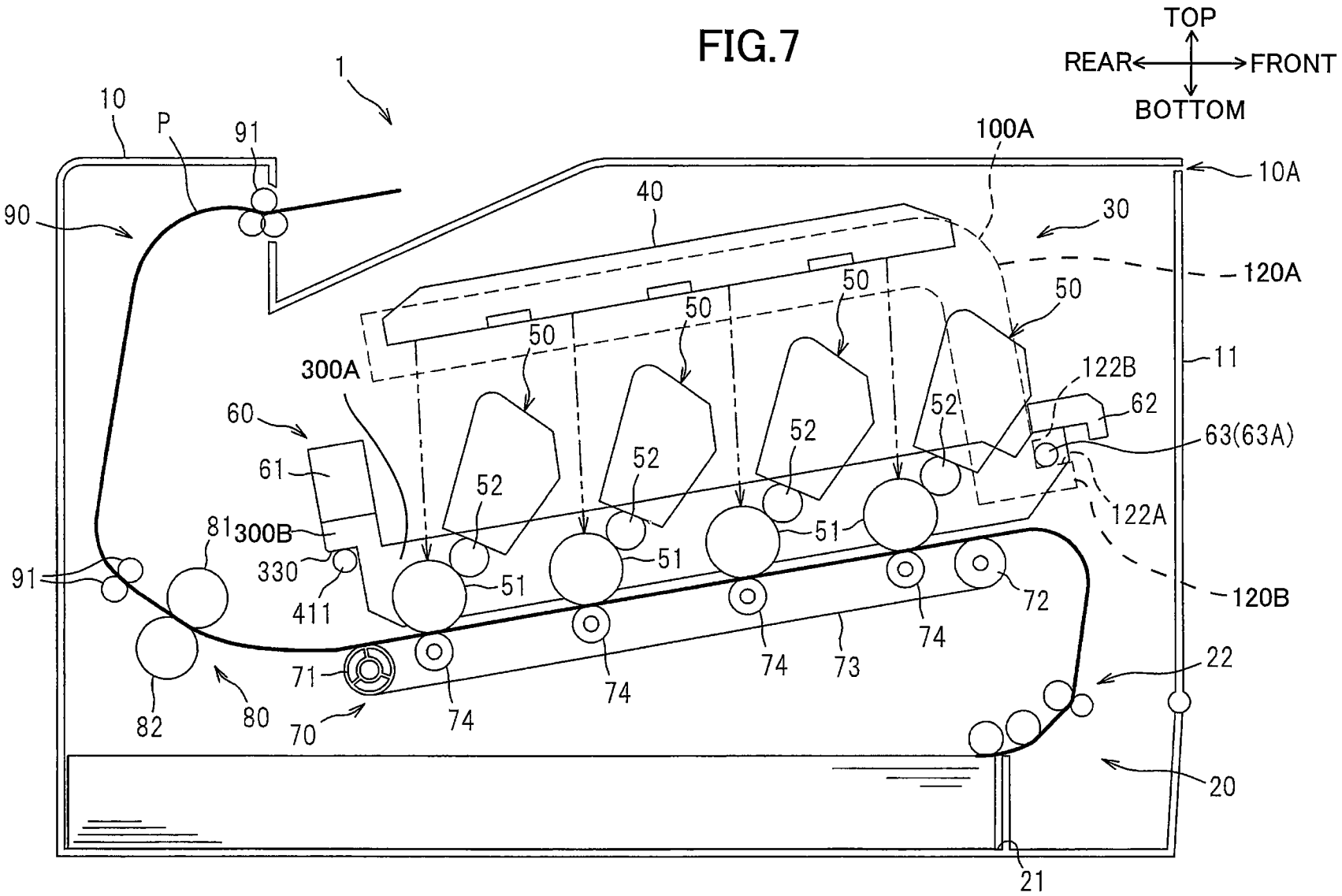
FIG. 7 is a schematic cross-sectional side view of a color printer according to a modification.

Various modifications may be conceivable. For example, in the above-described embodiment, the second surface 121B of the notched portion 121 is directed diagonally downward and rearward. However, the shape of the notched portion is not limited to this shape as long as positioning of the holder in the frontward/rearward direction can be achieved. For example, as shown in FIG. 7, instead of the formation of the notched portion, an extension portion 120A of a metal plate frame 100A has a lower end portion provided with a protruding part 120B protruding frontward so as to provide a first surface 122A extending in generally frontward/rearward direction and a second surface 122B extending in generally vertical direction. The first surface 122A is in contact with the axial end portion 63A of the shaft 63 from below so that the vertical position of the holder 60 can be fixed. The second surface 122B is in contact with the axial end portion 63A from rearward, so that frontward/rearward position of the holder 60 can be fixed.

Further, as shown in FIG. 7, instead of the employment of the support member 400 attached to the resin plate frame 200, a resin plate frame integrally provided with a protrusion 411 is available. The protrusion 411 protrudes from an inner surface of the resin plate frame 200. A metal plate 300A of the holder 60 has a rear portion provided with a protrusion 300B protruding rearward to provide an L-shaped configuration. The protrusion 300B provides a supported surface 330 to which the protrusion 411 is abuttable from below. Thus, the protrusion 411 supports the rear end portion of the metal plate 300A.

Further, in the above-described embodiment, the conveyer belt 73 is provided for conveying the sheet P. However, instead of the conveyer belt 73, an intermediate transfer belt to which a toner image is temporarily transferred is available.

Further, the present invention can also be applied other image forming apparatus such as a copying machine and a multifunction device.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a main frame; and a holder holding a plurality of photosensitive drums arrayed in an array direction, and movable in an accommodating direction parallel to the array direction to be accommodated in the main frame, the holder comprising a pair of side plates each positioned at each axial end portion of each photosensitive drum, and each having an upstream end portion in the accommodating direction, and a pair of protruding portions each protruding outward in an axial direction from the upstream end portion of each side plate;

wherein the main frame comprises:

a pair of positioning portions each configured to be in contact with a protruding portion of the pair of protruding portions from below and on a downstream side of the protruding portion in the accommodating direction for positioning the holder relative to the main frame; and a pair of support portions positioned downstream of the pair of positioning portions in the accommodating direction and configured to support the pair of side plates, wherein the main frame includes a pair of particular side walls made from a metal, each positioning portion being provided at each particular side wall, the image forming apparatus further comprising an exposure unit positioned between the pair of particular side walls and configured to expose the plurality of photosensitive drums to light; and wherein each particular side wall includes a major portion supporting the exposure unit and an extension portion extending from the major portion toward the photosensitive drum, each positioning portion being provided at each extension portion.

2. The image forming apparatus as claimed in claim 1, wherein the main frame further includes a pair of further side walls spaced away from each other in the axial direction and made from a resin, each particular side wall being fixed to each further side wall, and each support portion being provided at each further side wall.

3. The image forming apparatus as claimed in claim 1, wherein the protruding portions are axial end portions of a single shaft made from a metal.

4. The image forming apparatus as claimed in claim 1, further comprising a belt extending downward toward the downstream side in the accommodating direction, the holder being movable along the belt.

5. The image forming apparatus as claimed in claim 1, wherein the positioning portion has a first surface in contact with the protruding portion from below, and a second surface extending downward toward the downstream side in the accommodating direction and configured to be in contact with the protruding portion from diagonally above and on a downstream side of the protruding portion.

6. An image forming apparatus comprising:

a main frame; and a holder holding a photosensitive drum, and movable in an accommodating direction to be accommodated in the main frame, the holder comprising a pair of side plates each positioned at an axial end portion of the photosensitive drum, and having an upstream end portion in the accommodating direction, and a protruding portion protruding outward in an axial direction from the upstream end portion of each side plate;

wherein the main frame comprises:

a positioning portion configured to be in contact with the protruding portion for positioning the holder relative to the main frame; and a support portion positioned downstream of the positioning portion in the accommodating direction and configured to support the side plate, wherein the main frame includes a pair of particular side walls made from a metal, each positioning portion being provided at each particular side wall, the image forming apparatus further comprising an exposure unit positioned between the pair of particular side walls and configured to expose the photosensitive drum to light; and wherein each particular side wall includes a major portion supporting the exposure unit and an extension portion extending from the major portion toward the photosensitive drum, each positioning portion being provided at each extension portion.

7. The image forming apparatus as claimed in claim 6, wherein the main frame further includes a pair of further side walls spaced away from each other in the axial direction and made from a resin, each particular side wall being fixed to each further side wall, and each support portion being provided at each further side wall.

8. The image forming apparatus as claimed in claim 6, wherein the protruding portions are axial end portions of a single shaft made from a metal.

9. The image forming apparatus as claimed in claim 6, further comprising a belt extending downward toward a downstream side in the accommodating direction, the holder being movable along the belt.

10. The image forming apparatus as claimed in claim 6, wherein the positioning portion has a first surface in contact with each protruding portion from below, and a second surface extending downward toward a downstream side in the accommodating direction and configured to be in contact with each protruding portion from diagonally above and on a downstream side of the protruding portion.

11. An image forming apparatus comprising:

a main frame; and a holder holding a plurality of photosensitive drums arrayed in an array direction, and movable in an accommodating direction parallel to the array direction to be accommodated in the main frame, the holder comprising a pair of side plates each positioned at each axial end portion of each photosensitive drum, and each having an upstream end portion in the accommodating direction, and a pair of protruding portions each protruding outward in an axial direction from the upstream end portion of each side plate, wherein the main frame comprises:

a pair of positioning portions each configured to be in contact with a protruding portion of the pair of protruding portions from below and on a downstream side of the protruding portion in the accommodating direction for positioning the holder relative to the main frame; and a pair of support portions positioned downstream of the pair of positioning portions in the accommodating direction and configured to support the pair of side plates, and wherein the pair of support portions has an urging part configured to urge the holder so as to prevent a vertical rattling of the holder, wherein the main frame includes a pair of particular side walls made from a metal, each positioning portion being provided at each particular side wall, and wherein the image forming apparatus further comprises:

an exposure unit positioned between the pair of particular side walls and configured to expose the plurality of photosensitive drums to light, wherein each particular side wall includes a major portion supporting the exposure unit and an extension portion extending from the major portion toward the photosensitive drum, each positioning portion being provided at each extension portion.

12. The image forming apparatus according to claim 11, wherein each of the pair of side plates has an inclined surface inclined downward toward the accommodating direction, and wherein the urging part is configured to urge the inclined surface downward.

13. The image forming apparatus as claimed in claim 11, wherein the main frame further includes a pair of further side walls spaced away from each other in the axial direction and made from a resin, each particular side wall being fixed to each further side wall, and each support portion being provided at each further side wall.

14. The image forming apparatus as claimed in claim 11, wherein the protruding portions are axial end portions of a single shaft made from a metal.

15. The image forming apparatus as claimed in claim 11, further comprising a belt extending downward toward the downstream side in the accommodating direction, the holder being movable along the belt.

16. The image forming apparatus as claimed in claim 11, wherein the positioning portion has a first surface in contact with each protruding portion from below, and a second surface extending downward toward the downstream side in the accommodating direction and configured to be in contact with each protruding portion from diagonally above and on a downstream side of the protruding portion.

* * * * *